US010086965B2

(12) United States Patent
Hellenbrand

(10) Patent No.: US 10,086,965 B2
(45) Date of Patent: Oct. 2, 2018

(54) TUBE BLISTER PACKAGING APPARATUS AND METHOD

(71) Applicant: CareFusion Germany 326 GmbH, Kelberg (DE)

(72) Inventor: Christoph Hellenbrand, Kaifenheim (DE)

(73) Assignee: CareFusion Germany 326 GmbH, Kelberg (DE)

( * ) Notice: Subject to any disclaimer, the term of this patent is extended or adjusted under 35 U.S.C. 154(b) by 629 days.

(21) Appl. No.: 14/689,155

(22) Filed: Apr. 17, 2015

(65) Prior Publication Data

US 2016/0304229 A1 Oct. 20, 2016

(51) Int. Cl.
*B65B 57/14* (2006.01)
*B65B 35/30* (2006.01)
(Continued)

(52) U.S. Cl.
CPC ..... *B65B 57/14* (2013.01); *B65B 9/08* (2013.01); *B65B 35/04* (2013.01); *B65B 35/30* (2013.01); *B65B 35/44* (2013.01); *B65B 37/02* (2013.01)

(58) Field of Classification Search
CPC ..... B65B 37/02; B65B 35/30; B65B 35/44; B65B 35/04; B65B 9/08; B65B 57/14
(Continued)

(56) References Cited

U.S. PATENT DOCUMENTS

2009/0133362 A1* 5/2009 Bentele ..... B65B 5/103 53/54
2012/0290129 A1 11/2012 Luciano, Jr. et al.
(Continued)

FOREIGN PATENT DOCUMENTS

DE 102008047975 A1 4/2010
EP 2 067 699 A1 6/2009
(Continued)

OTHER PUBLICATIONS

European Search Report issued in EP Appln. No. 151639515.5 dated Oct. 28, 2015 (5 pages).

*Primary Examiner* — Andrew M Tecco
*Assistant Examiner* — Xavier A Madison
(74) *Attorney, Agent, or Firm* — McDermott Will & Emery LLP

(57) ABSTRACT

An apparatus for the production of tube blister packages includes dispensing stations and a collection apparatus for providing medication doses to a blister packaging apparatus. The blister packaging apparatus fills the received medication doses, by groups, into pockets of a tube blister package. An inspection buffer apparatus disposed between the collection apparatus and the blister packaging apparatus includes a buffer apparatus for temporarily storing at least one group of medication doses intended for being filled into a pocket, a sensor apparatus for detecting an image and/or predetermined properties of the temporarily stored group of medication doses, and an evaluation and control device. The evaluation and control device determines whether the temporarily stored group of medication doses corresponds to a group of medication doses to be filled in, and if so, passes the temporarily stored group on to the blister packaging apparatus.

17 Claims, 5 Drawing Sheets

(51) Int. Cl.

| | |
|---|---|
| ***B65B 37/00*** | (2006.01) |
| ***A61J 1/03*** | (2006.01) |
| ***B65B 1/04*** | (2006.01) |
| ***B65B 35/04*** | (2006.01) |
| ***B65B 35/44*** | (2006.01) |
| ***B65B 37/02*** | (2006.01) |
| ***B65B 9/08*** | (2012.01) |

(58) Field of Classification Search
USPC ..... 53/443
See application file for complete search history.

(56) References Cited

U.S. PATENT DOCUMENTS

| | | | | |
|---|---|---|---|---|
| 2012/0296592 | A1* | 11/2012 | Luciano, Jr. ..... | B65D 75/36<br>702/84 |
| 2014/0318078 | A1 | 10/2014 | Kondo et al. | |

FOREIGN PATENT DOCUMENTS

| | | | |
|---|---|---|---|
| JP | S59 22002 | Y2 | 7/1984 |
| JP | H11 206854 | A | 8/1999 |

* cited by examiner

TUBE BLISTER PACKAGING APPARATUS AND METHOD

BACKGROUND

The present disclosure relates to an apparatus and method for the production of tube blister packages.

In many medical treatment settings, it is desirable to provide a packaging apparatus for the production of tube blister packages without the effort and expenditure of new production of a tube blister package or repair of a tube blister package if defective pocket filling is determined. For example, an apparatus for buffering and checking a group of medication doses checks the correctness of the group of medication doses intended to be filled into a pocket even before it is filled in and to prevent filling if a defect is found, thus eliminating the need for an entire tube blister package to be newly produced or repaired because of a defectively filled pocket.

SUMMARY

The disclosed embodiments provide a medication packaging apparatus for producing tube blister packages of medications, including a plurality of supply containers configured to make medication doses available and one or more dispensing apparatuses configured to selectively dispensing medication doses from the supply containers. The medication packaging apparatus also includes a collection apparatus configured to pick up the medication doses dispensed by the one or more dispensing apparatuses and to pass on the medication doses, and a blister packaging apparatus configured to fill the received medication doses, by groups, into pockets of a tube blister package, wherein a group of medication doses filled into a pocket includes one medication dose, multiple similar medication doses or different medication doses. The medication packaging apparatus further includes an inspection buffer apparatus disposed between the collection apparatus and the blister packaging apparatus. The inspection buffer apparatus includes a buffer apparatus configured to pick up the medication doses passed on by the collection apparatus and to temporarily store at least one group of medication doses intended to be filled into a pocket and a sensor apparatus configured to detect at least one of an image and predetermined properties of the temporarily stored group of medication doses. The inspection buffer apparatus also includes an evaluation and control device configured to determine, on the basis of the detected at least one of the image and the predetermined properties, whether the temporarily stored group of medication doses corresponds to a predetermined group of medication doses to be filled in, and configured to control the buffer apparatus to pass the temporarily stored group on to the blister packaging apparatus only if the temporarily stored group corresponds to the predetermined group.

The disclosed embodiments also provide a packaging apparatus for producing tube blister packages of medications, including a plurality of medication supply containers and a plurality of dispensing devices configured to selectively dispense medication doses from the plurality of medication supply containers. The packaging apparatus also includes a collection device configured to pick up the medication doses dispensed by the plurality of dispensing devices and a blister packaging device configured to receive the medication doses from the collection device and to fill the received medication doses into pockets of a tube blister package. The packaging apparatus further includes an inspection buffer device disposed between the collection device and the blister packaging device, the inspection buffer device including a buffer device configured to receive medication doses from the collection apparatus and to temporarily store at least one group of medication doses intended to be filled into a pocket; a sensor device configured to detect at least one of an image of the temporarily stored group of medication doses and predetermined properties of the temporarily stored group of medication doses; and an evaluation and control device configured to determine if the temporarily stored group of medication doses corresponds to a predetermined group of medication doses to be filled in and control the buffer apparatus to pass on the temporarily stored group of medication doses.

The disclosed embodiments also provide a method for packaging medications in blister tube packages, including dispensing, by one or more dispensing apparatuses, medication doses from one or more medication supply containers and collecting, by a collecting apparatus, the dispensed medication doses. The method also includes receiving, by a buffer apparatus, the medication doses from the collection apparatus and temporarily storing, by the buffer apparatus, at least one group of medication doses intended to be filled into a pocket of a blister package. The method further includes detecting, by a sensor apparatus, at least one of an image of the temporarily stored group of medication doses and predetermined properties of the temporarily stored group of medication doses and determining, by an evaluation and control apparatus, if the temporarily stored group of medication doses corresponds to a predetermined group of medication doses. The method also includes conducting, or passing on, by the buffer apparatus, the temporarily stored group of medication doses to a blister packaging apparatus only if the temporarily stored group corresponds to the predetermined group.

The foregoing and other features, aspects and advantages of the disclosed embodiments will become more apparent from the following detailed description and accompanying drawings.

DETAILED DESCRIPTION OF THE DRAWINGS

Figure 1:
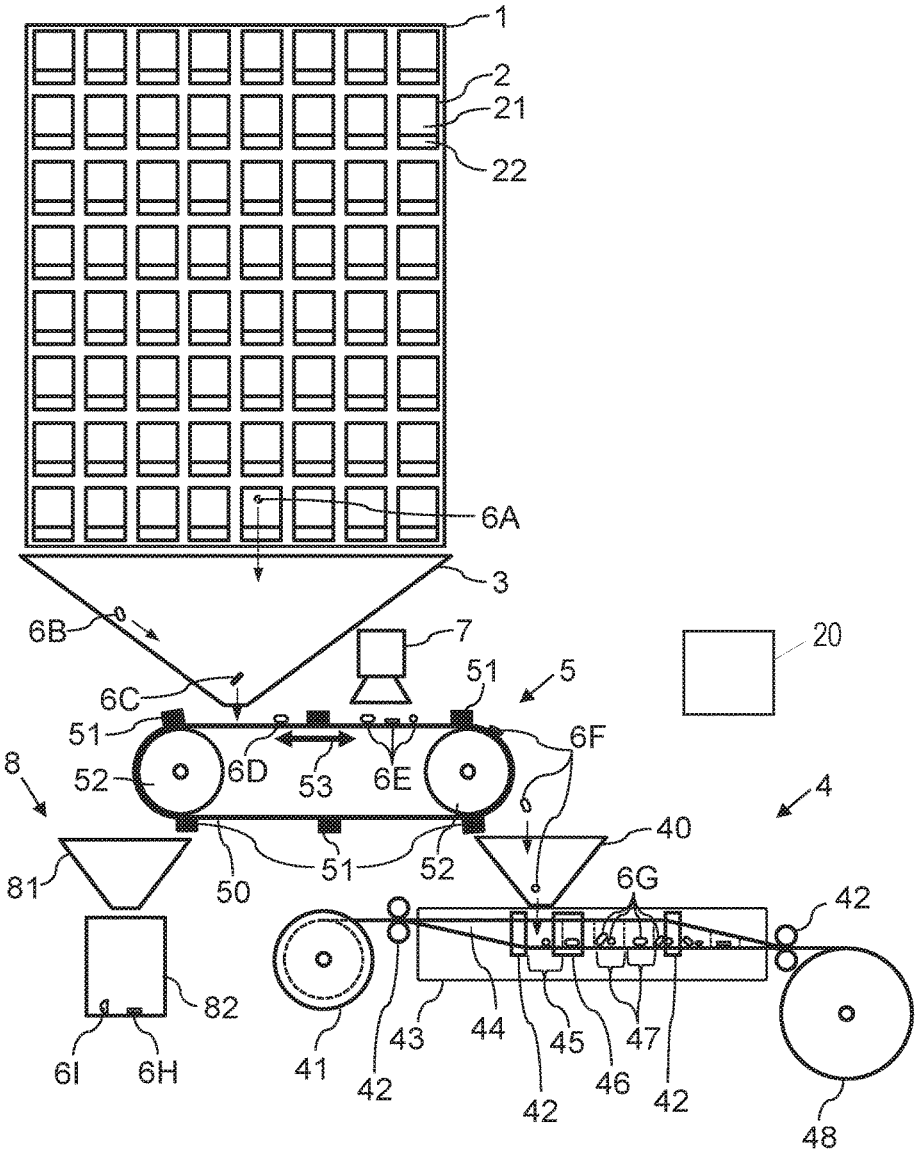
FIG. 1 is a front elevation view of a typical apparatus for the production of tube blister packages.

The detailed description set forth below describes various configurations of the subject technology and is not intended to represent the only configurations in which the subject technology may be practiced. The detailed description includes specific details for the purpose of providing a thorough understanding of the subject technology. Accordingly, dimensions are provided in regard to certain aspects as non-limiting examples. However, it will be apparent to those skilled in the art that the subject technology may be practiced without these specific details. In some instances, well-known structures and components are shown in block diagram form in order to avoid obscuring the concepts of the subject technology.

It is to be understood that the present disclosure includes examples of the subject technology and does not limit the scope of the appended claims. Various aspects of the subject technology will now be disclosed according to particular but non-limiting examples. Various embodiments described in the present disclosure may be carried out in different ways and variations, and in accordance with a desired application or implementation.

Automatic blister packaging machines are usable in pharmacies and hospitals, and with corresponding dimensioning in blister packaging centers, by compiling medications individually by patient in accordance with the times for taking them ordered by the physician. The packaging device of the automatic blister packaging machine packages the medication sets, which may contain only one medication or a plurality of individual medications, into a pouch formed from an endless packaging material web (e.g., blister pack). The pouch leaves the packaging device for further use as a "blister tube" (e.g., the concatenated filled blister packs that are not yet separated). A blister pack generally corresponds to a time for taking a medication of a patient as it contains all medications which a patient must take in the morning, for example.

Some automatic blister packaging machines include multiple supply containers for making medication doses available, dispensing apparatuses for selective dispensing of medication doses from the supply containers, and a collection apparatus for picking up the medication doses dispensed by the dispensing apparatuses and passing the medication doses on to a blister packaging apparatus. The blister packaging apparatus then fills the received medication doses, by groups, into pockets of a tube blister package, where a group filled into a pocket represents a medication dose or multiple similar or different medication doses.

Some automatic blister packaging machines are used for packaging medications in blister packages, particularly for packaging medications in blister packages in a patient-individual manner. In this connection, the medications of a patient are packaged in correctly dispensed doses. A tube blister package is usually a chain of connected tube bags or pockets, wherein each bag or each pocket contains those medication doses (in other words film tablets, capsules or coated tablets) that a patient is supposed to take at a predetermined administration time. The tube blister packages are usually labeled with the name of the patient, the respective administration times, the medications contained in them, as well as with expiration dates and lot numbers.

For example, a tube blister package for a patient who is supposed to take a predetermined number and type of medications in the morning, at noon, and in the evening, in each instance, may contain three tube bags or pockets for every day, so that a tube blister package intended for a week has 21 pockets.

These tube blister packages are produced using automated equipment, as shown in FIG. 1. Such automated equipment may contain multiple supply containers 21, where a plurality of medication doses of a predetermined type of medication is contained in each supply container 21, for example. Each supply container 21 is coupled with a dispensing apparatus 22 for selective dispensing of individual medication doses, where the supply container 21 and the dispensing apparatus form a dispensing station 2. Medication doses 6A, 6B, 6C exiting from the dispensing apparatuses 22 are caught by a catch funnel 3, for example, and dispensed to a blister packaging apparatus 4 at an exit opening of the catch funnel 3.

A control apparatus of the automated equipment ensures that the medication doses 6G intended for being filled into a tube bag or an open pocket 45 are dispensed from the corresponding dispensing stations 2 at approximately the same time from the related dispensing apparatuses 22, fall into the catch funnel 3, and are dispensed to the blister packaging apparatus 4 together. The blister packaging apparatus 4 forms a tube blister package from a packaging material 41 that is made available, where every time when an open pocket 45 is formed, the group of medication doses to be introduced into the pocket is introduced from the catch funnel 3 into the open pocket 45, which is still open at the top, whereupon the open pocket 45 is immediately sealed by a sealer 46 (e.g., heat roller) to become a sealed pocket 47. This process is repeated for each pocket 45, 47 produced one after the other. The tube blister package produced in this manner is rolled up into a roll 48, for example.

Using this method of filling the bags of the tube blister package, various defects can occur. For example, medication doses to be filled in can be destroyed, (e.g., film tablets can break or capsules can burst). Medication doses can also be missing, or incorrect or superfluous medication doses can get into an open pocket 45 by mistake.

It is advantageous to subject the produced tube blister packages to a thorough inspection after their production. In this connection, the content of each individual pocket of a tube blister package is successively checked, and as shown schematically in FIG. 4, the roll 48 of the wound-up tube blister packages is removed and passed to an inspection station 100, as a roll 101 to be inspected. The roll 101 is unwound so that the individual blister pockets 47 lie next to one another and can be guided past an optical inspection apparatus having a camera 103. If a defect is found during this process, usually not only the pocket 47 and the contents 6G in question must be discarded, but rather the entire tube blister package must be discarded. The affected tube blister package is then produced once again. Alternatively, the content of the affected pocket could be repaired manually, which leads to great effort and expenditure. If no defect is found in the inspection station 100, the properly filled tube blister package can be wound back up into a roll 102.

It is provided by the present disclosure to avoid the aforementioned effort and expenditure of the new production or repair of a tube blister package if defective pocket filling is determined.

An apparatus for the production of tube blister packages may have a plurality of supply containers for making available medication doses (in other words, for example, film tablets, capsules or coated tablets), and dispensing apparatuses for selective dispensing of medication doses from the supply containers. The supply containers may be, for example, of a first supply container type, which contains a plurality of similar medication doses of a predetermined type of medication and is coupled with a dispensing apparatus for selective dispensing of individual medication doses. In this connection, the dispensing apparatus may be part of a dispensing station that contains the supply container, for example. Alternatively or additionally, multiple supply containers of a second type may be provided, each containing a medication dose or a few similar or different medication doses. Such supply containers may be formed, for example, by small holding compartments of a supply magazine that can be filled manually and are disposed, in matrix-like manner, in horizontal rows and/or columns.

The apparatus for the production of tube blister packages may also have a collection apparatus for picking up the medication doses dispensed by the dispensing apparatuses and for passing the medication doses on to a blister packaging apparatus. The blister packaging apparatus fills the received medication doses, by groups, into pockets of a tube blister package, where a group filled into a pocket is one medication dose or also multiple similar or different medication doses. An inspection buffer apparatus may be disposed between the collection apparatus and the blister packaging apparatus. The inspection buffer apparatus contains a buffer apparatus for picking up the medication doses passed on by the collection apparatus and for temporary storage of at least one group of medication doses intended for being filled into a pocket and a sensor apparatus for detecting an image and/or predetermined properties of the temporarily stored group of medication doses.

The inspection buffer apparatus also contains an evaluation and control device that determines, using the image detected by the sensor apparatus and/or the predetermined properties detected by the sensor apparatus, whether the temporarily stored group of medication doses corresponds to a predetermined group of medication doses to be filled in, and controls the buffer apparatus in such a manner that the latter passes the temporarily stored group on to the blister packaging apparatus only if the temporarily stored group corresponds to the predetermined group. The evaluation and control apparatus therefore determines whether the temporarily stored group, as the "actual group," corresponds to a predetermined group, as the "reference group."

Interposition of an inspection buffer apparatus (e.g., an apparatus for buffering and checking a group of medication doses) makes it possible to check the correctness of the group of medication doses intended to be filled into a pocket even before it is filled in, and, if a defect is found, to prevent filling. The defective group may then be discarded, for example, and newly compiled in a subsequent step of repeated activation of the dispensing apparatuses. Though this may reduce the speed of production of the tube blister packages, it also permits the production of tube blister packages that do not have to be inspected again subsequently.

The buffer apparatus may have a transport apparatus that picks up the medication doses passed on by the collection apparatus at a first location, and transports the medication doses to a second location, at which the sensor apparatus detects the image and/or the predetermined properties of the temporarily stored group of medication doses. Provision of the transport apparatus allows spatial separation of catch location (first location) and inspection location (second location), and permits simplification of the design. For this purpose, the transport apparatus may include suitable holding containers and provide for moving the holding containers, which pick up the medication doses at the first location, until a respective group is complete, and then are transported to the second location, at which the sensor apparatus detects the image and/or the predetermined properties. The transport apparatus may, on the other hand, do without movement of containers, and instead include mechanical steering and or guide apparatuses so that the arriving medication doses are caught at one location and steered to the second location by the steering apparatuses.

The transport apparatus may pass the temporarily stored group on to the blister packaging apparatus if the temporarily stored group of medication doses corresponds to the predetermined group of medication doses to be filled in (in other words the actual group corresponds to the reference group).

If the temporarily stored group is missing one or more medication doses, the temporarily stored group of medication doses does not correspond to the predetermined group of medication doses to be filled in. Thus, the transport apparatus may transport the temporarily stored group back to the first location in order to be able to supply a missing medication dose or doses to the group there. This allows immediate correction of such a group before it is filled into the pocket of the tube blister package.

If the temporarily stored group contains incorrect, defective and/or superfluous medication doses, the temporarily stored group of medication doses also does not correspond to the predetermined group of medication doses to be filled in. Thus, the transport apparatus may discard the temporarily stored group. For example, the group may be discarded in that it is transported to a waste container.

The method of procedure of the return transport of the group to the first location if it is determined that medication doses are missing may be combined with the method of procedure of discarding the group if incorrect, defective, or superfluous medication doses are found.

The apparatus for the production of tube blister packages may have a transport apparatus that includes a horizontal conveyor having at least one holding compartment that may be moved to the first location for picking up medication doses and to the second location for detecting an image and/or predetermined properties of the group by the sensor apparatus. For example, the horizontal conveyor (e.g., a circulating conveyor belt) may be moved in such a manner that a holding compartment is at first situated at a first location, at which it catches the medication doses. Afterward, the holding compartment may be moved horizontally, in a first transport direction, to the second location, at which the sensor apparatus detects the image and/or the predetermined properties. If it is then found, for example, that the temporarily stored group (e.g., actual group) corresponds to the predetermined group of medication doses to be filled in (e.g., reference group), then the horizontal conveyor may be moved further in the first direction, to a third location, at which the holding compartment is emptied (for example tipped out), where the exiting medication doses are filled into a pocket of the tube blister package that is still open.

If, however, it is determined that the temporarily stored group of medication doses does not correspond to the predetermined group of medication doses to be filled in, because a medication dose or multiple medication doses are missing, the horizontal conveyor may move the holding compartment back in the opposite direction, to the first location. Here, missing medication doses may be added. Alternatively, all defective temporarily stored groups of medication doses may be transported back in the opposite direction, beyond the first location, to a fourth location, at which the defective groups may be emptied into a waste container. The preferred use of the horizontal conveyor, particularly of a circulating conveyor belt, simplifies the design structure and control of the movement of the temporarily stored group from the first location to the second location and then to the blister packaging apparatus or to a waste container.

The transport apparatus may include a chute, the upper end of which is situated at the first location (at which the medication doses are taken over from the collection apparatus) and which has a catch apparatus for catching the medication doses that are sliding down at the second location. The caught medication doses may then be subjected to inspection (while they are sliding down or afterward). The catch apparatus may be controlled by the evaluation and control device in such a manner that it releases the temporarily stored group to the blister packaging apparatus only if the temporarily stored group formed by catching the medication doses that are sliding down corresponds to the predetermined group. Provision of the chute also permits a simple design structure. The catch apparatus may include a releasable barrier, for example, which may be disposed crosswise above the chute. The barrier may be configured in such a manner that it either guides the caught group of medication doses onto a first descending path that leads to the blister packaging apparatus, or to a second descending path that leads to a waste container.

The sensor apparatus may include a camera that produces an electronic image of the temporarily stored group of medication doses. The camera may be an optical camera, which produces an image of the emissions in the range of visible light and/or in the range of infrared light, for example. In addition, an apparatus may be provided, which irradiates the group of medication doses with visible light and/or with infrared light at predetermined frequencies. Multiple images may be produced successively at different lighting frequencies and/or at different viewing angles.

The buffer apparatus may have a mechanical separation apparatus that separates the medication doses of the temporarily stored group from one another before detection of the image (or the images), in such a manner that the medication doses do not reciprocally cover one another in the image (or in the images). This mechanical separation apparatus may include a shaker apparatus, for example.

The sensor apparatus may include a scale. The scale may determine the total weight of the medication doses of a group. In this case, the evaluation and control device contains a memory that contains the individual weights of all the medication doses kept on hand in the apparatus. On the basis of the reference composition of the group, the evaluation and control device determines a reference total weight, which is then compared with the actual total weight detected by the scale.

The collection apparatus may include a collection or catch funnel disposed below the medication supply container. In this connection, the exit openings of the dispensing apparatuses may be disposed in such a manner that all the dispensed medication doses enter into the collection funnel and reach its bottom within a predetermined time interval.

Multiple supply containers of the first type may be disposed one on top of the other and contain a plurality of the same type of medication doses, together with multiple related dispensing apparatuses, may form a vertical column of dispensing stations. Multiple dispensing station columns may be disposed next to one another in a plane, thereby forming a vertical matrix of dispensing stations. Here, the collection apparatus may have a plurality of vertical guide shafts that may be moved horizontally past the dispensing station columns, which shafts have pickup openings at the levels corresponding to the vertical positions of the dispensing apparatuses, into which openings the dispensing apparatuses may dispense medication doses as a guide shaft moves past them, so that the medication doses move downward in the guide shafts and exit from a dispensing opening at their lower ends. In this regard, a collection container may be disposed below the dispensing opening of each guide shaft, which container, together with the guide shaft, is moved horizontally, catches the medication doses of a group, in each instance, and then dispenses them to the inspection buffer apparatus, after the related guide shaft has been moved past the dispensing station columns.

The collection containers may additionally be moved past and below dispensing apparatuses of a plurality of supply containers of a second type, which each contain only one medication dose or a few similar or different medication doses, so that the individual medication dose or the few medication doses of one or more types of medication contained in the supply containers of the second type may be dispensed into a collection container that is moving past them. This increases the flexibility and the spectrum of the types of medications that can be filled into the pockets of the tube blister packages.

Figure 2:
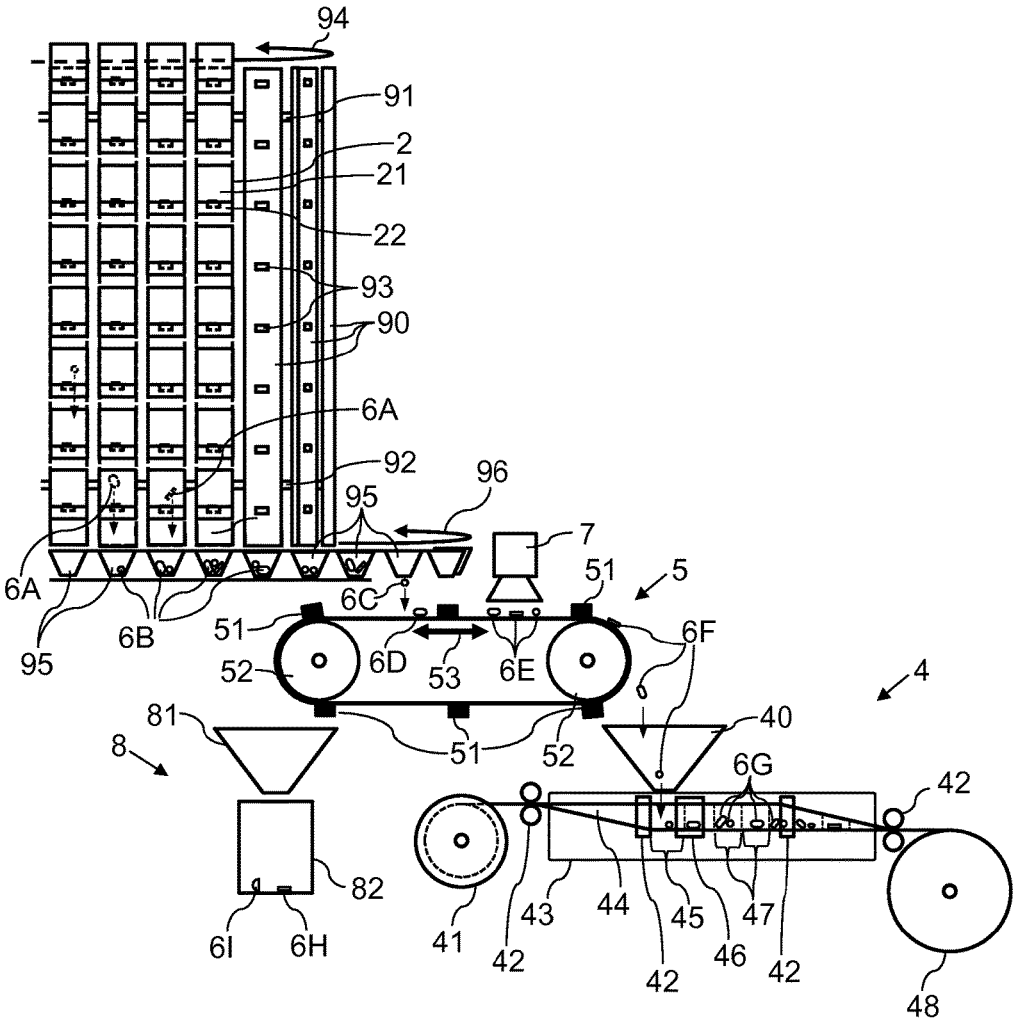
FIG. 2 is a front elevation view of an embodiment of a packaging apparatus for the production of tube blister packages.

FIG. 2 shows an embodiment of an apparatus for the production of tube blister packages. The apparatus comprises a medication supply storage unit 1, which includes multiple supply containers 21 for different medications. Each supply container 21 may hold multiple similar medication doses of a predetermined type of medication. Each supply container 21 has a dispensing apparatus 22 assigned to it, with which individual medication doses may be selectively removed from the supply container 21 and dispensed. The supply container 21 (e.g., a canister) forms a dispensing station 2, together with the dispensing apparatus 22. In some embodiments, the dispensing station 2 comprises a dispensing apparatus 22, fixed in place on an assembly frame, the dispensing apparatus 22 having a holder that a supply container 21 may be set on. The supply container 21 may be manually removed from the dispensing station 2, in order to be refilled, for example.

In the exemplary embodiment shown in FIG. 2, the dispensing stations 2 are disposed on a front side of a wall, for example, and this wall has openings through which the dispensing apparatuses 22 allow the medication doses to pass, so that the medication doses move downward into a catch funnel 3 behind the wall. In FIG. 2, a medication dose 6A is shown schematically, which dose is falling downward behind the wall that holds the dispensing stations 2, into the catch funnel 3. A further medication dose 6B that has already fallen into the catch funnel 3 is sliding along the side wall of the funnel 3 to an exit opening. A third medication dose 6C, which has been dispensed by one of the dispensing apparatuses 22 at approximately the same time as the two other medication doses 6A and 6B, is shown in a position in which it is passing through the exit opening of the catch funnel 3.

The dispensing apparatuses 22 of all the dispensing stations 2 may be controlled by a control computer of the apparatus for the production of tube blister packages, in such a manner that the medication doses of a group that is to be filled into a pocket of a tube blister package fall into the catch funnel 3 at approximately the same time, and leave the funnel through its exit opening.

At the exit opening of the catch funnel 3, the exiting medication doses are caught by a buffer apparatus 5. The buffer apparatus 5 includes a horizontal conveyor belt 50, which runs in forward and backward directions 53 over deflection rollers 52, and on the outside of which holding compartments are formed, using delimitation walls 51. The medication doses 6C exiting from the catch funnel 3 fall into a holding compartment formed on the conveyor belt 50 by the delimitation walls 51. As soon as a group of medication doses 6D to be filled into a pocket of the tube blister package has collected in the holding compartment of the conveyor belt 50, the conveyor belt 50 may be moved further (e.g., to the right in FIG. 2), so that the medication doses 6E contained in the holding compartment get into the detection range of a sensor apparatus 7 (e.g., a camera). Here, the camera of the sensor apparatus 7 detects an image of the group of medication doses 6E and passes the image on to an evaluation and control device 20, which may be an integral part of the control computer of the apparatus for the production of tube blister packages.

Further sensors may be disposed on the conveyor belt 50, for example, such as photo eyes or other radiation detectors, which detect the other predetermined properties of the group of medication doses 6E and pass them on to the evaluation and control device 20. The evaluation and control device 20 determines, using an image detected by the sensor apparatus 7 or the predetermined properties detected by the sensor apparatus 7, whether the temporarily stored group of medication doses 6E on the conveyor belt 50 corresponds to a group of medication doses to be filled in, the properties of which are stored in a memory of the evaluation and control device 20. For example, the shape, the color, and the shine of all the medication doses stored in the supply containers 21 may be stored in memory. At the same time, the evaluation and control device 20 knows what groups of medication doses are successively supposed to be filled into the pockets of the tube blister package.

From this information concerning the groups and the stored properties of the medication doses, the evaluation and control device 20 may determine a reference image, which may be compared with properties of the image detected by the camera 7. For example, the evaluation and control device 20 may contain object recognition software that evaluates the image detected by the camera 7. As soon as the evaluation and control device 20 has determined that the temporarily stored group of medication doses 6E corresponds to the predetermined group of medication doses to be filled in, the conveyor belt 50 may be moved further, so that the group of medication doses may be passed on to a blister packaging apparatus 4.

For example, the conveyor belt 50 is guided over a deflection roller 52, below which a catch funnel 40 of the blister packaging apparatus 4 is disposed. When the conveyor belt 50 runs over the deflection roller 52, the medication doses 6F fall into the catch funnel 40 and thereby get to the blister packaging apparatus 4.

Below the dispensing opening of the catch funnel 40, a pocket of a tube blister package, which pocket is open at the top, is formed by the blister packaging apparatus 4. This is done in that a strip of plastic film 44 made available on a supply roller 41 is deflected by way of deflection rollers 42 and thereby folded to form a pocket 45 that is open at the top, in the interior of a housing 43 of the blister packaging apparatus 4, where the two halves of the plastic strip of film 44 (e.g., thermoplastic film), which then lie against one another, are welded transverse to the transport direction, in order to thereby form the delimitations of the consecutive pockets. As soon as a pocket 45 of the tube blister package that is still open at the top has been formed by the transverse welding, the group of medication doses 6F to be contained in the pocket may be filled in. Subsequently, the pocket may be welded at its top, in the longitudinal direction, so that the group of medication doses that has been filled in is enclosed in a sealed pocket 47.

FIG. 2 shows individual sealed pockets 47 of the tube blister package, which are filled with groups of medication doses 6G. A group of medication doses 6G filled into a sealed pocket 47 of a tube blister package may include, for example, an individual medication dose (e.g., a tablet, a capsule, or a coated tablet), or it may also include multiple similar or different medication doses. The tube blister package produced in this manner is in turn deflected over guide rollers 42 and wound up into a roll 48.

If, however, the evaluation and control device 20 determines, using the image detected by the camera of the sensor apparatus 7 and/or using other predetermined properties determined by the sensor apparatus 7, that the group of medication doses 6E temporarily stored by the buffer apparatus 5 on the conveyor belt 50 does not correspond to the related predetermined group of medication doses to be filled in, then this group of medication doses 6E may not be transported further in the direction of the blister packaging apparatus 4. Instead, the group of medication doses may be corrected, if it is found that medication doses are missing (e.g., it is filled up), or the group of medication doses may be discarded, particularly if it is found that medication doses are incorrect, missing, or superfluous. If the evaluation and control device 20 can clearly determine, on the basis of the information from the sensor apparatus, whether and what medication doses in the group are missing, then the conveyor belt 50 may be moved in the opposite direction (e.g., to the left in FIG. 2), so that the holding compartment containing the incomplete group gets back below the exit opening of the catch funnel 3. Subsequently, corresponding dispensing apparatuses 22 may be controlled in such a manner that the missing medication doses fall into the catch funnel 3, and from there get into the holding compartment on the conveyor belt 50 that is to be completed. Subsequently, the conveyor belt 50 may be moved to the right again, so that the camera 7 may once again detect an image of the supplemented group of medication doses 6E.

If, however, it is found that the group of medication doses 6E contains incorrect, defective (e.g. broken) and/or superfluous medication doses, the conveyor belt 50 may be moved back so far to the left that the holding compartment on the conveyor belt 50 is moved over the left deflection roller 52, so that the defective group of medication doses fall into a catch funnel 81 of a discarding apparatus 8. From there, the medication doses are directed into or otherwise get into a waste container 82. The waste container thereby collects medication doses 6H and parts of medication doses 6I of the defective groups, which were discarded. After discarding the defective group of medication doses, subsequently a new group of medication doses may be compiled for the same pocket of the tube blister package, and subjected to an inspection using the camera 7.

These procedures may be repeated until a tube blister package having correctly filled pockets has been produced. A tube blister package produced in this manner subsequently does not need to be subjected to an inspection with regard to defective filling.

Figure 3:
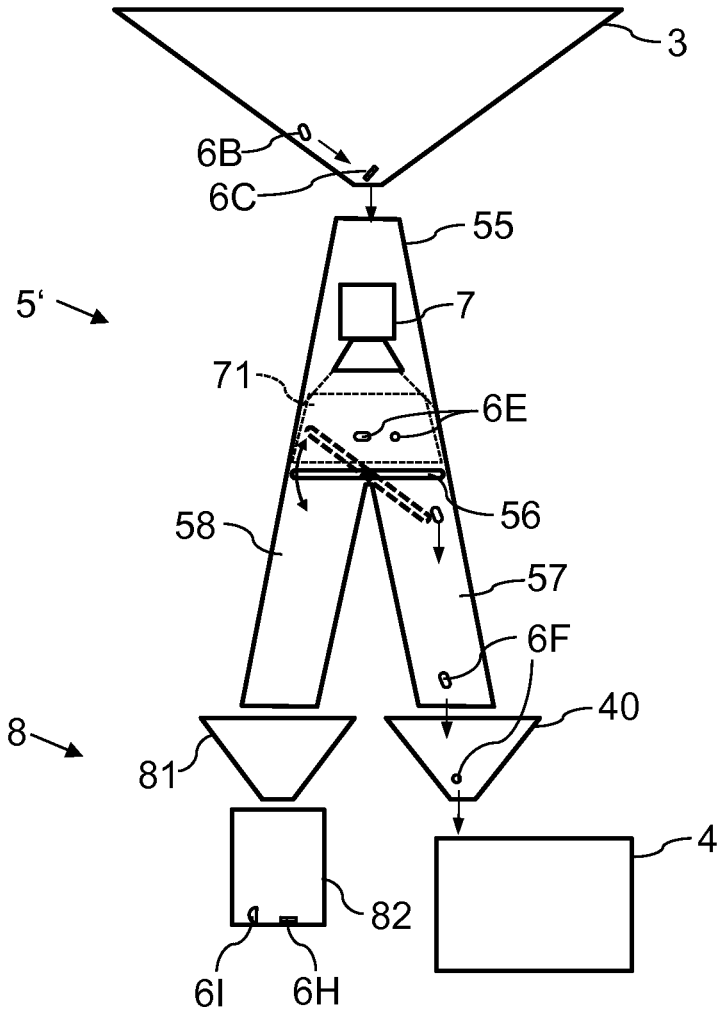
FIG. 3 is a front elevation view of an embodiment of a packaging apparatus for the production of tube blister packages.

FIG. 3 shows an embodiment containing dispensing stations 2, a buffer apparatus 5, a blister packaging apparatus 4, and a discarding apparatus 8, which do not differ from the corresponding apparatuses of the exemplary embodiment according to FIG. 2. Thus, these are not described in any detail here. The apparatus according to FIG. 3 differs from the apparatus according to FIG. 2 only with regard to the method of how the medication doses dispensed by the dispensing apparatuses 22 of the dispensing stations 2 are passed on to the buffer apparatus 5. As in the exemplary embodiment according to FIG. 2, in the embodiment according to FIG. 3 the medication doses are also stored in supply containers 21. The dispensing stations 2, which consist of supply containers 21 and dispensing apparatuses 22, are controlled by the control computer of the apparatus for the production of tube blister packages, in the same manner, so that the medication doses to be filled in are dispensed. In this connection, however, the medication doses do not fall into a large, common collection funnel.

Instead, a guide shaft 90 is positioned adjacent to a vertical column of dispensing stations 2 disposed one on top of the other. The guide shaft 90 is a vertical guide shaft that is hollow on the inside and has a number of entry openings 93 disposed one on top of the other. When such a guide shaft 90 is positioned directly behind and adjacent to a vertical column of dispensing stations 2, the entry openings 93 are situated adjacent to the exit openings of the dispensing apparatuses 22 of the dispensing station column. The medication doses exiting out of the dispensing apparatuses 22 thereby enter into the vertical guide shaft 90 through the entry openings 93, and fall downward in the shaft. The guide shafts 90 are moved further, in the horizontal direction, from one vertical column to the adjacent column, in each instance, so that they are moved past all the columns of dispensing stations 2 during every cycle. With appropriate cycling of the dispensing of medication doses by the dispensing apparatuses 22, each dispensing station 2 can thereby dispense its medication doses into a specific guide shaft 90. Furthermore, it is possible that when a column of dispensing stations 2 dispenses its medication doses into a first guide shaft 90, an adjacent column of dispensing stations 2 may dispense its medication doses into an adjacent guide shaft 90. This allows collecting groups of medication doses in parallel, in terms of time, in different guide shafts 90.

There are small collection containers 95 below the lower ends of the guide shafts 90, which are moved together with the guide shafts 90. The medication doses that fall down in the guide shafts 90 fall into these collection containers, so that the individual groups of medication doses can be successively collected in the chain of collection containers 95.

The dispensing stations 2 are disposed, for example, in a matrix of columns and rows, in a horizontal plane, where the guide shafts 90 move adjacent to this vertical plane of dispensing stations 2. Accordingly, the guide shafts 90 are connected with transport belts 92, for example, which guide the guide shafts 90 in a plane behind the dispensing stations 2, at first, and then deflect them, so that the guide shafts 90 are brought back again and can be moved past the dispensing stations 2 once again. Deflection of the guide shafts 90, which are coupled with one another, is illustrated by an arrow 94. The collection containers 95 are also connected with one another to form a chain, and are moved in the horizontal direction at the same speed as the guide shafts 90. Here, too, deflection of the chain of collection containers 95 is illustrated with an arrow 96. The collection containers 95 are preferably guided past the deflection point of the guide shafts 90 (e.g., farther to the right in FIG. 3), where they can be emptied into holding compartments of the transport apparatus 50 of the buffer device 5.

Figure 4:
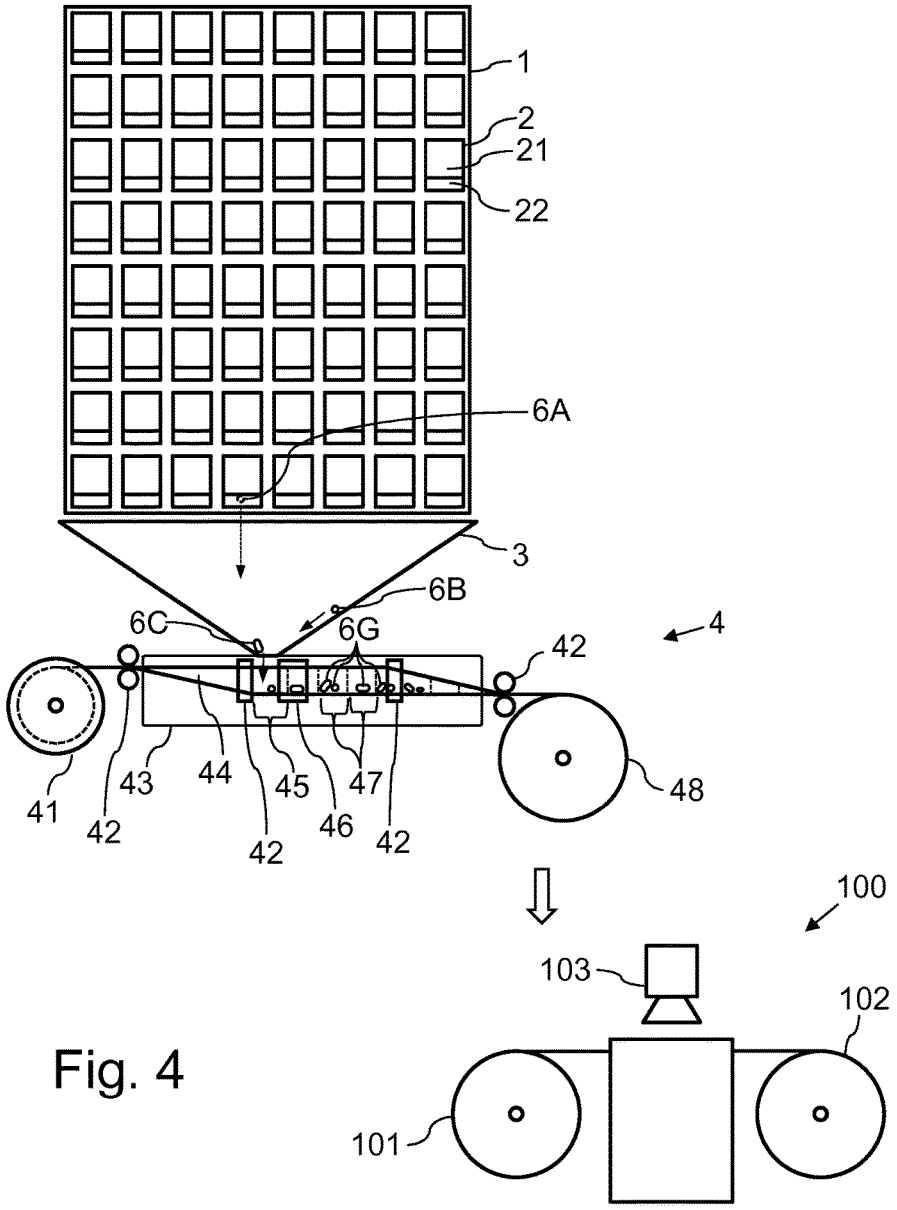
FIG. 4 is a front elevation view of an embodiment of a buffer apparatus.

FIG. 4 shows an embodiment of a buffer apparatus 5', which does not use a conveyor belt, but rather a chute 55 for transporting the medication doses. The chute 55 may be inclined in such a manner that the medication doses 6C exiting from the dispensing opening of the collection funnel 3 impact the highest point of the chute and from there slide downward, at first to a catch region, at which a barrier 56 prevents further sliding of the medication doses. The medication doses 6E that are sliding downward therefore collect above the barrier 56 and may then situated in a detection region 71 of the camera 7. The camera 7, in turn, may detect an image of the medication doses 6E temporarily stored there, which image may be passed on to the evaluation and control device 20. The evaluation and control device 20 may determine, using the image detected by the camera 7, whether the group of medication doses 6E temporarily stored in the catch region corresponds to a predetermined group of medication doses to be filled in. If this is the case, the barrier 56 may be released in such a manner that the medication doses 6E move further on a subsequent chute 57, where the medication doses 6F then fall into a catch funnel 40 of the blister packaging apparatus 4 that has already been described in connection with FIG. 2.

If, however, the evaluation and control device 20 determines that the temporarily stored group of medication doses 6E does not correspond to the predetermined group of medication doses to be filled in, then the barrier 56 may be released in a different manner, so that the medication doses 6E now get onto a different chute 58, from which they fall into a catch funnel 81 of a waste container 82.

Within the scope of the idea of the disclosure, numerous alternative embodiments are conceivable. Combinations of conveyor belts and chutes or alternative transport apparatuses can be used. The buffer apparatus may preferably be configured in such a manner that the transport path between the first location, at which the medication doses are caught, and the second location, at which the sensor apparatus detects an image or predetermined properties of the medication doses, are as short as possible. The transport apparatus may also be structured so that if a defective group of medication doses is determined at the location of the sensor device, collection of a corrected replacement group of medication doses is immediately started at the first location, and that the defective group is discarded while the replacement group is being moved to the sensor apparatus. If, in the case of such an embodiment, the conveyor belt shown in FIGS. 2 and 3 is used, then a deflection device for the medication doses 6F that fall down there may be situated at the right end of the conveyor belt 50 (e.g., at the right deflection roller 52), where this deflection apparatus either guides the falling medication doses into the catch funnel 40 of the blister packaging apparatus 4 (if the group is correct) or into a catch funnel 81 of a waste container 82 (if the group is defective).

Figure 5:
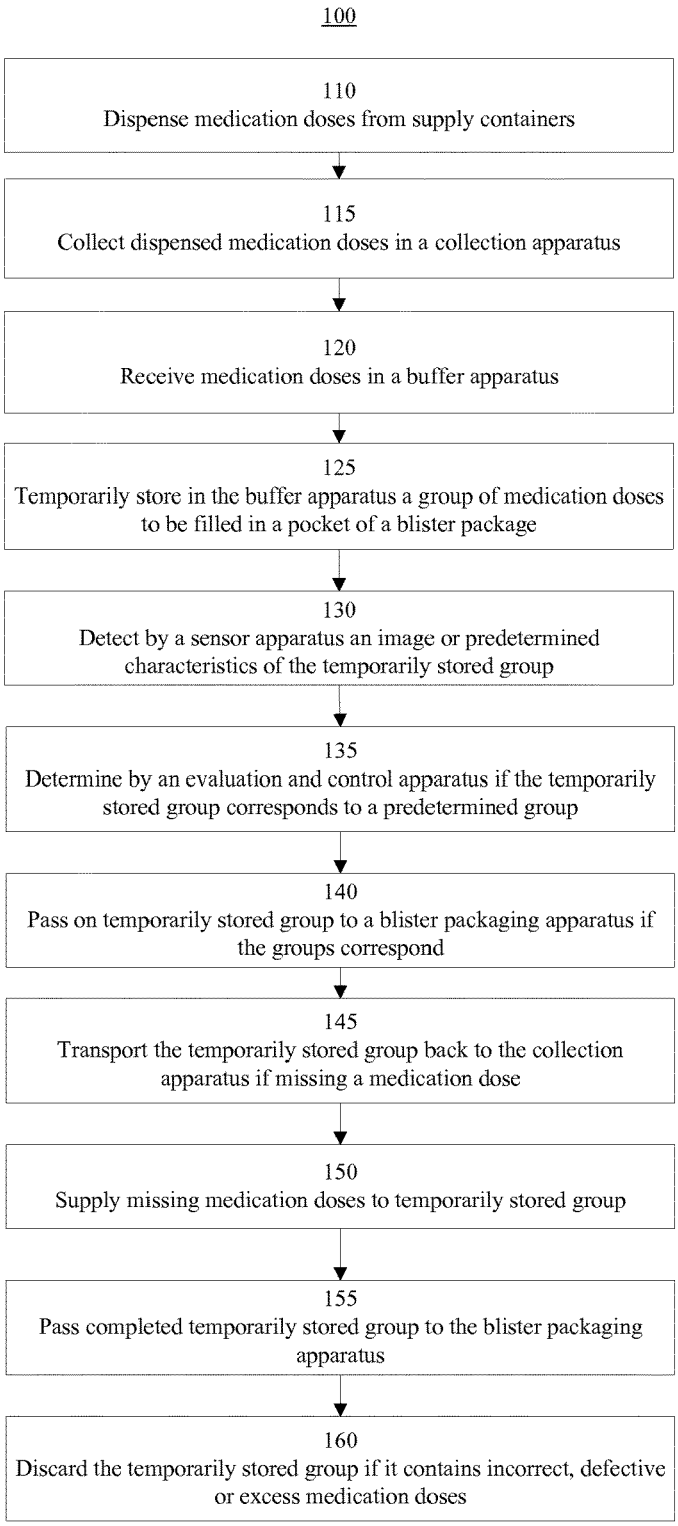
FIG. 5 is a flow chart illustrating steps in a method for packaging medications in tube blister packages, according to some embodiments.

FIG. 5 shows a flow chart illustrating steps in a method 100 for the production of tube blister packages, according to some embodiments. Method 100 may be performed in connection with packaging devices consistent with the present disclosure.

Steps in method 100 may be performed at least partially by an operator, medical personnel, or a healthcare professional in a healthcare facility or in a drugstore, or in a pharma manufacturing facility. Accordingly, method 100 may be part of a medicament management or a drug logistic prepared by a physician or a healthcare professional. Moreover, method 100 may be performed automatically upon execution of a command provided by or controlled by a healthcare professional. For example, steps in method 100 may be programmed or directed with commands on computer-readable media, which, in some embodiments, can comprise non-transitory computer readable media.

Methods consistent with the present disclosure may include at least one of the steps illustrated in FIG. 5, performed in any order. In some embodiments, a method may include at least two of the steps illustrated in FIG. 5 performed overlapping in time, or even simultaneously. Moreover, embodiments consistent with the present disclosure may include at least one but not all of the steps illustrated in FIG. 5. Furthermore, methods consistent with the present disclosure may include more steps, in addition to at least one of the steps illustrated in FIG. 5. In some embodiments, one or more steps may be repeated.

Step 110 includes dispensing, by one or more dispensing apparatuses, medication doses from one or more medication supply containers. Step 115 includes collecting, by a collecting apparatus, the dispensed medication doses. Step 120 includes receiving, by a buffer apparatus, the medication doses from the collection apparatus. Step 125 includes temporarily storing, by the buffer apparatus, at least one group of medication doses intended to be filled into a pocket of a blister package. Step 130 includes detecting, by a sensor apparatus, at least one of an image of the temporarily stored group of medication doses and predetermined properties of the temporarily stored group of medication doses. Step 135 includes determining, by an evaluation and control apparatus, if the temporarily stored group of medication doses corresponds to a predetermined group of medication doses. Step 140 includes passing on, by the buffer apparatus, the temporarily stored group of medication doses to a blister packaging apparatus only if the temporarily stored group corresponds to the predetermined group.

Further steps may include step 145, transporting, by a transport apparatus, the temporarily stored group back to the collection apparatus if the temporarily stored group does not correspond to the predetermined group because the temporarily stored group is missing one or more medication doses. Step 150 includes supplying, from the collection apparatus, the missing medication doses to the temporarily stored group to form a completed temporarily stored group. Step 155 includes passing on, or conducting, the completed temporarily stored group to the blister packaging apparatus. Step 160 includes discarding, by the transport apparatus, the temporarily stored group if the temporarily stored group does not correspond to the predetermined group because the temporarily stored group contains at least one of incorrect, defective and excess medication doses.

It is understood that any specific order or hierarchy of blocks in the methods of processes disclosed is an illustration of example approaches. Based upon design or implementation preferences, it is understood that the specific order or hierarchy of blocks in the processes may be rearranged, or that all illustrated blocks be performed. In some implementations, any of the blocks may be performed simultaneously.

The present disclosure is provided to enable any person skilled in the art to practice the various aspects described herein. The disclosure provides various examples of the subject technology, and the subject technology is not limited to these examples. Various modifications to these aspects will be readily apparent to those skilled in the art, and the generic principles defined herein may be applied to other aspects.

A reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the invention.

The word "exemplary" is used herein to mean "serving as an example or illustration." Any aspect or design described herein as "exemplary" is not necessarily to be construed as preferred or advantageous over other aspects or designs. In one aspect, various alternative configurations and operations described herein may be considered to be at least equivalent.

As used herein, the phrase "at least one of" preceding a series of items, with the term "or" to separate any of the items, modifies the list as a whole, rather than each item of the list. The phrase "at least one of" does not require selection of at least one item; rather, the phrase allows a meaning that includes at least one of any one of the items, and/or at least one of any combination of the items, and/or at least one of each of the items. By way of example, the phrase "at least one of A, B, or C" may refer to: only A, only B, or only C; or any combination of A, B, and C.

A phrase such as an "aspect" does not imply that such aspect is essential to the subject technology or that such aspect applies to all configurations of the subject technology. A disclosure relating to an aspect may apply to all configurations, or one or more configurations. An aspect may provide one or more examples. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. An embodiment may provide one or more examples. A phrase such an embodiment may refer to one or more embodiments and vice versa. A phrase such as a "configuration" does not imply that such configuration is essential to the subject technology or that such configuration applies to all configurations of the subject technology. A disclosure relating to a configuration may apply to all configurations, or one or more configurations. A configuration may provide one or more examples. A phrase such a configuration may refer to one or more configurations and vice versa.

In one aspect, unless otherwise stated, all measurements, values, ratings, positions, magnitudes, sizes, and other specifications that are set forth in this specification, including in the claims that follow, are approximate, not exact. In one aspect, they are intended to have a reasonable range that is consistent with the functions to which they relate and with what is customary in the art to which they pertain.

It is understood that the specific order or hierarchy of steps, operations or processes disclosed is an illustration of exemplary approaches. Based upon design preferences, it is understood that the specific order or hierarchy of steps, operations or processes may be rearranged. Some of the steps, operations or processes may be performed simultaneously. Some or all of the steps, operations, or processes may be performed automatically, without the intervention of a user. The accompanying method claims, if any, present elements of the various steps, operations or processes in a sample order, and are not meant to be limited to the specific order or hierarchy presented.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112 (f) unless the element is expressly recited using the phrase "means for" or, in the case of a method claim, the element is recited using the phrase "step for." Furthermore, to the extent that the term "include," "have," or the like is used, such term is intended to be inclusive in a manner similar to the term "comprise" as "comprise" is interpreted when employed as a transitional word in a claim.

The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. In addition, in the Detailed Description, it can be seen that the description provides illustrative examples and the various features are grouped together in various embodiments for the purpose of streamlining the disclosure. This method of disclosure is not to be interpreted as reflecting an intention that the claimed subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

The claims are not intended to be limited to the aspects described herein, but are to be accorded the full scope consistent with the language claims and to encompass all legal equivalents. Notwithstanding, none of the claims are intended to embrace subject matter that fails to satisfy the requirement of 35 U.S.C. § 101, 102, or 103, nor should they be interpreted in such a way.

What is claimed is:

1. A medication packaging apparatus for producing tube blister packages of medications, comprising:

a plurality of supply containers configured to make medication doses available;

one or more dispensing apparatuses configured to selectively dispense medication doses from the supply containers;

a collection apparatus configured to pick up the medication doses dispensed by the one or more dispensing apparatuses and to pass on the medication doses;

a blister packaging apparatus configured to fill the received medication doses, by groups, into pockets of a tube blister package, wherein a group of medication doses filled into a pocket comprises one medication dose or multiple similar or different medication doses; and an inspection buffer apparatus disposed between the collection apparatus and the blister packaging apparatus, the inspection buffer apparatus comprising:

a buffer apparatus configured to pick up the medication doses passed on by the collection apparatus and to temporarily store at least one group of medication doses intended to be filled into a pocket;

a sensor apparatus configured to detect at least one of an image and predetermined properties of the temporarily stored group of medication doses;

an evaluation and control device configured to determine, on the basis of the detected at least one of the image and the predetermined properties, whether the temporarily stored group of medication doses corresponds to a predetermined group of medication doses to be filled in, and configured to control the buffer apparatus to pass the temporarily stored group on to the blister packaging apparatus only if the temporarily stored group corresponds to the predetermined group; and a transport apparatus comprising a reversible conveyor, wherein the reversible conveyor is configured to pick up the medication doses passed on by the collection apparatus at a first location, and to transport the medication doses to a second location, wherein the sensor apparatus is configured to detect the at least one of the image and the predetermined properties of the temporarily stored group of medication doses at the second location, wherein the reversible conveyors is configured to transport the temporarily stored group back to the first location if the temporarily stored group of medication doses does not correspond to the predetermined group of medication doses to be filled in because the temporarily stored group is missing one or more medication doses, and wherein the reversible conveyor is configured to add the missing medication doses from the collection apparatus to the temporarily stored group back at the first location.

2. The medication packaging apparatus of claim 1, wherein the transport apparatus is configured to pass the temporarily stored group on to the blister packaging apparatus if the temporarily stored group of medication doses corresponds to the predetermined group of medication doses to be filled in.

3. The medication packaging apparatus of claim 1, wherein the transport apparatus is configured to discard the temporarily stored group if the temporarily stored group of medication doses does not correspond to the predetermined group of medication doses to be filled in because the temporarily stored group contains at least one of incorrect, defective and excess medication doses.

4. The medication packaging apparatus of claim 1, wherein the transport apparatus comprises a horizontal conveyor having at least one holding compartment, the at least one holding compartment configured to be moved to the first location for receiving medication doses and to be moved to the second location for detecting the at least one of the image and the predetermined properties of the group by the sensor apparatus.

5. The medication packaging apparatus of claim 1, wherein the sensor apparatus comprises a camera configured to detect an image of the temporarily stored group of medication doses.

6. The medication packaging apparatus of claim 5, wherein the buffer apparatus comprises a mechanical separation apparatus configured to separate the medication doses of the temporarily stored group before the image is recorded, so that the medication doses do not reciprocally cover one another in the image.

7. The medication packaging apparatus of claim 1, wherein the sensor apparatus comprises a scale.

8. The medication packaging apparatus of claim 1, wherein the collection apparatus comprises a collection funnel disposed below the medication supply container.

9. The medication packaging apparatus of claim 1, wherein the supply containers comprise at least one of first supply containers that each contain a plurality of the same medication doses of a predetermined type of medication and second supply containers that each contain only one medication dose or a few medication doses of one or more types of medications.

10. The medication packaging apparatus of claim 9, further comprising:

multiple first supply containers, each having a related dispensing apparatus, stacked one on top of the other to form multiple vertical columns of dispensing stations disposed next to one another in a plane;

the collection apparatus comprising a plurality of vertical guide shafts configured to be moved horizontally past the vertical dispensing station columns, each vertical guide shaft comprising a pickup opening into which the dispensing apparatuses are configured to dispense medication doses when a guide shaft moves past the dispensing apparatuses so that the medication doses move downward in the guide shafts and exit from a dispensing opening at a lower end; and a plurality of collection containers disposed below the plurality of vertical guide shafts, each collection container, together with a corresponding vertical guide shaft, configured to be moved horizontally, to catch the medication doses of a respective group, and to dispense the caught medication doses to the inspection buffer apparatus after the corresponding vertical guide shaft has been moved past the dispensing station columns.

11. The medication packaging apparatus of claim 10, wherein the collection containers are configured to be moved below dispensing apparatuses of the second supply containers so that one or more medication doses contained in the second supply containers are dispensed into one or more collection containers.

12. A packaging apparatus for producing tube blister packages of medications, comprising:

a plurality of medication supply containers;

a plurality of dispensing devices configured to selectively dispense medication doses from the plurality of medication supply containers;

a collection device configured to pick up the medication doses dispensed by the plurality of dispensing devices;

a blister packaging device configured to receive the medication doses from the collection device and to fill the received medication doses into pockets of a tube blister package; and an inspection buffer device disposed between the collection device and the blister packaging device, the inspection buffer device comprising:

a buffer device configured to receive medication doses from the collection apparatus and to temporarily store at least one group of medication doses intended to be filled into a pocket;

a sensor device configured to detect at least one of an image of the temporarily stored group of medication doses and predetermined properties of the temporarily stored group of medication doses;

an evaluation and control device configured to:

determine if the temporarily stored group of medication doses corresponds to a predetermined group of medication doses to be filled in; and control the buffer apparatus to pass on the temporarily stored group of medication doses; and a transport apparatus comprising a reversible conveyor, wherein the reversible conveyor is configured to pick up the temporarily stored group of medication doses at a first location, transport the temporarily stored group of medication doses to the sensor apparatus at a second location, and transport the temporarily stored group of medication doses back to the first location if the temporarily stored group of medication doses does not correspond to the predetermined group of medication doses to be filled in because the temporarily stored group of medication doses is missing one or more medication doses.

13. The packaging apparatus of claim 12, wherein the transport apparatus is configured to:

pass the temporarily stored group on to the blister packaging apparatus if the temporarily stored group of medication doses corresponds to the predetermined group of medication doses to be filled in.

14. The packaging apparatus of claim 12, wherein the transport apparatus is configured to:

discard the temporarily stored group if the temporarily stored group of medication doses does not correspond to the predetermined group of medication doses to be filled in because the temporarily stored group contains at least one of incorrect, defective and excess medication doses.

15. The packaging apparatus of claim 12, wherein the transport apparatus comprises:

a horizontal conveyor having at least one holding compartment, the at least one holding compartment configured to be moved to the first location to receive medication doses and to be moved to the second location to be engaged by the sensor apparatus.

16. A method for packaging medications in blister tube packages, the method comprising:

dispensing, by one or more dispensing apparatuses, medication doses from one or more medication supply containers;

collecting, by a collecting apparatus, the dispensed medication doses;

receiving, by a buffer apparatus, the medication doses from the collection apparatus;

temporarily storing, by the buffer apparatus, at least one group of medication doses intended to be filled into a pocket of a blister package;

detecting, by a sensor apparatus, at least one of an image of the temporarily stored group of medication doses and predetermined properties of the temporarily stored group of medication doses;

determining, by an evaluation and control apparatus, if the temporarily stored group of medication doses corresponds to a predetermined group of medication doses;

conducting, by the buffer apparatus, the temporarily stored group of medication doses to a blister packaging apparatus only if the temporarily stored group corresponds to the predetermined group; and transporting, by a transport apparatus, the temporarily stored group back to the collection apparatus if the temporarily stored group does not correspond to the predetermined group because the temporarily stored group is missing one or more medication doses.

17. The method of claim 16, further comprising:

supplying, from the collection apparatus, the missing medication doses to the temporarily stored group to form a completed temporarily stored group;

conducting the completed temporarily stored group to the blister packaging apparatus; and discarding, by the transport apparatus, the temporarily stored group if the temporarily stored group does not correspond to the predetermined group because the temporarily stored group contains at least one of incorrect, defective and excess medication doses.

* * * * *